United States Patent [19]

Hermle

[11] 4,424,423

[45] Jan. 3, 1984

[54] SWITCHING MECHANISM

[76] Inventor: Eduard Hermle, Kirchstrasse 20, D-7303 Neuhausen a.F., Fed. Rep. of Germany

[21] Appl. No.: 308,806

[22] Filed: Oct. 5, 1981

[30] Foreign Application Priority Data

Oct. 23, 1980 [DE] Fed. Rep. of Germany ..... 3039968

[51] Int. Cl.[3] ..... H01H 3/42

[52] U.S. Cl. ..... 200/31 R; 74/568 R; 200/153 LB

[58] Field of Search ..... 200/27 R, 27 B, 30 R, 200/31 A, 38 BA, 38 CA, 153 LB; 74/568 R, 568 T

[56] References Cited

U.S. PATENT DOCUMENTS

| | | | |
|---|---|---|---|
| 3,364,317 | 1/1968 | Hermle | 200/153 LB X |
| 3,483,344 | 12/1969 | Hermle | 200/38 BA X |
| 3,839,925 | 10/1974 | Ficken et al. | 74/568 T X |
| 4,238,654 | 12/1980 | Hermle | 200/31 R X |
| 4,348,568 | 9/1982 | Hermle | 200/153 LB |

FOREIGN PATENT DOCUMENTS

| | | | |
|---|---|---|---|
| 2912914 | 10/1980 | Fed. Rep. of Germany | 200/153 LB |

*Primary Examiner*—J. R. Scott

*Attorney, Agent, or Firm*—Kenway & Jenney

[57] ABSTRACT

A switching mechanism has disc cams arranged on a shaft for actuating switches positioned beside the shaft. The cam discs are adjusted exclusively by friction contact between these cam discs and at least one supporting member. The friction surfaces are held in contact with each other under pressure from a plate spring which is positioned outside of the pair of cam discs. The tension of the plate spring is selected so as to be great enough to ensure that the cam discs do not rotate relative to the shaft unintentionally, particularly when subjected to accelerations and impacts during operation. The tension is, however, at a level which allows a sliding adjustment of the cams with the use of a tool. The tension is preferably determined by the rate of the plate spring and a fixed axial spacing in which it is confined. This spacing is set, in the preferred form, by the length of a bushing of one support member that abuts an adjacent cam unit or an equivalent stop member.

3 Claims, 2 Drawing Figures

SWITCHING MECHANISM

BACKGROUND OF THE INVENTION

The invention relates to a switching mechanism having a rotating control shaft bearing a cam unit per switch for activation of the switches disposed along the control shaft, each cam unit having several cam discs disposed on the control shaft and rotatable and lockable relative to this shaft, and having a securing means for preventing relative rotation of the cam discs.

Switching mechanisms of this kind are, for example, used to a great extent for the control of presses, with which each stroke has to be triggered by the operator. The safety factor is therefore of particularly great importance. Safety against accidents can, however, only be guaranteed if the cam discs of the switching mechanism do not readjust themselves, for example do not move once they have been adjusted to a certain position on the control shaft, despite the accelerations and retardations of the control shaft, which are particularly great and frequently occur in the case of individual stroke control.

In the case of most of the customary switching mechanisms of the type described at the beginning the cam discs are only secured by friction.

For example, the switching mechanism as described in DE-GM 73 21 672 has carrying bushes with a square aperture seated on a square portion of the control shaft so that they are secured on the control shaft against relative rotation in order to provide a form lock. Two cam discs are slid onto each carrying bush. These cam discs can be rotated on the carrying bush for the purpose of adjustment. The latter has a flange and a boss connected to it, the boss having an external thread and a flat portion on its circumference.

In order to secure the cam discs adjusted according to the desired switching points against rotation these cam discs are clamped tightly, by means of a ring nut screwed onto the carrying bush boss, between this nut and the carrying bush flange, for example the cam discs are merely secured by friction against rotation.

So that the adjusted cam discs do not rotate when the ring nut is tightened a pressure transmission ring is inserted between the ring nut and the cam disc adjacent to it, the aperture of this ring corresponding to the cross section of the carrying bush boss in the area of the circumferential flat portion so that the pressure transmission ring cannot turn when the ring nut is tightened.

As practice has, however, shown it is not absolutely guaranteed in the case of switching mechanisms having cam discs secured against rotation only by friction that the cam discs will not rotate relative to the control shaft under the influence of the accelerations and retardations occurring. This can result in accidents if the relevant cam discs control a switch responsible for safety.

The object of the invention is to improve a switching mechanism of the type described at the beginning such that neither a securing against rotation by friction or form-locking nor by a combined type of form-locking and friction contact is required for an absolutely reliable securing of the cam discs and the cam discs are clamped on the control shaft such that they may be delicately rotated by hand at any time to carry out any positional correction required.

SUMMARY OF THE INVENTION

In the case of the construction according to the invention the adjustment of the cam discs is performed exclusively by friction contact between these cam discs and at least one supporting member; the friction surfaces held in contact with each other under pressure and the tension of the plate springs can be selected so large as to guarantee the desired securing of the cam discs against relative rotation in the case where accelerations are retardations of the control shaft movement occur during operation and vary from case to case.

There is the possibility of selecting the interacting surfaces of centre plate and cam disc very large, the harmonization of materials of these parts to each other creating optimum ratios of friction.

This construction enables the generation of selected contact pressures because these pressures are generated exclusively by the plate springs which can be laid out accordingly.

The cam discs and the centre plate abut advantageously on each other with their plane parallel, end surfaces.

It is clear that the invention also covers a switching mechanism on the rotating control shaft of which only one cam unit is disposed for activation of a single switch.

It would also not be outside the scope of the invention to have a switching mechanism with which at least one cam unit has only one cam disc which is lockable on the control shaft by means of friction contact.

Further, discs having a pattern on their circumference and triggering a signal can be provided instead of one or pairs of cam discs disposed on the control shaft.

The plate spring can, for example, be disposed between one of the cam discs and a supporting member. In a preferred embodiment of the invention this spring is provided between the end face of the axially adjustable supporting member and the abutment disposed behind this supporting member.

It is further possible to have all the components of a cam unit disposed directly on the control shaft either rotatably or secured against relative rotation. In a further, advantageous development of the invention the supporting member axially secured on the control shaft forms a flanged bush bearing the cam discs and the other supporting member.

The abutment may either be disposed on the free end of the flanged bush or abut on its end face.

The abutment can be formed, for example, by a pressure disc mounted on the flanged bush and pressed against a shoulder surface of the flanged bush by means of a ring nut screwed onto the flanged bush. An abutment of this design will, for instance, be selected if the switching mechanism has only one cam unit. If, however, several cam units are disposed on the control shaft it is favourable to use as an abutment the cam unit adjacent to each cam unit or its flanged bush. In this case all the cam units are secured in position on the flanged bush with the aid of a ring nut screwed onto the control shaft in that the entire set of cam units is locked against a collar of the control shaft.

A further possibility of securing the cam discs on the control shaft is offered by use of locking washers, which are connected with the control shaft or the supporting members such that they cannot rotate relative to each other. The washers are disposed between the supporting members and the cam discs. These locking washers may be bent with peripheral portions into corresponding recesses of the cam discs in order to provide a form lock. Alternatively, the locking washers may be supported on the cam discs such that they do not rotate and be connected with the supporting members in order to provide a form lock. In a preferred construction the supporting members have, on their side facing the cam discs, a collar concentric to the control shaft and provided with gear teeth around its circumference. The locking washers engage with the gear teeth of this collar in order to provide a form lock.

BRIEF DESCRIPTION OF THE DRAWINGS

Additional features and details of the invention are explained in the following specification of an embodiment of a cam unit for a switching mechanism and/or in the claims. The drawings show:

DETAILED DESCRIPTION OF THE PREFERRED EMBODIMENT

Figure 1:
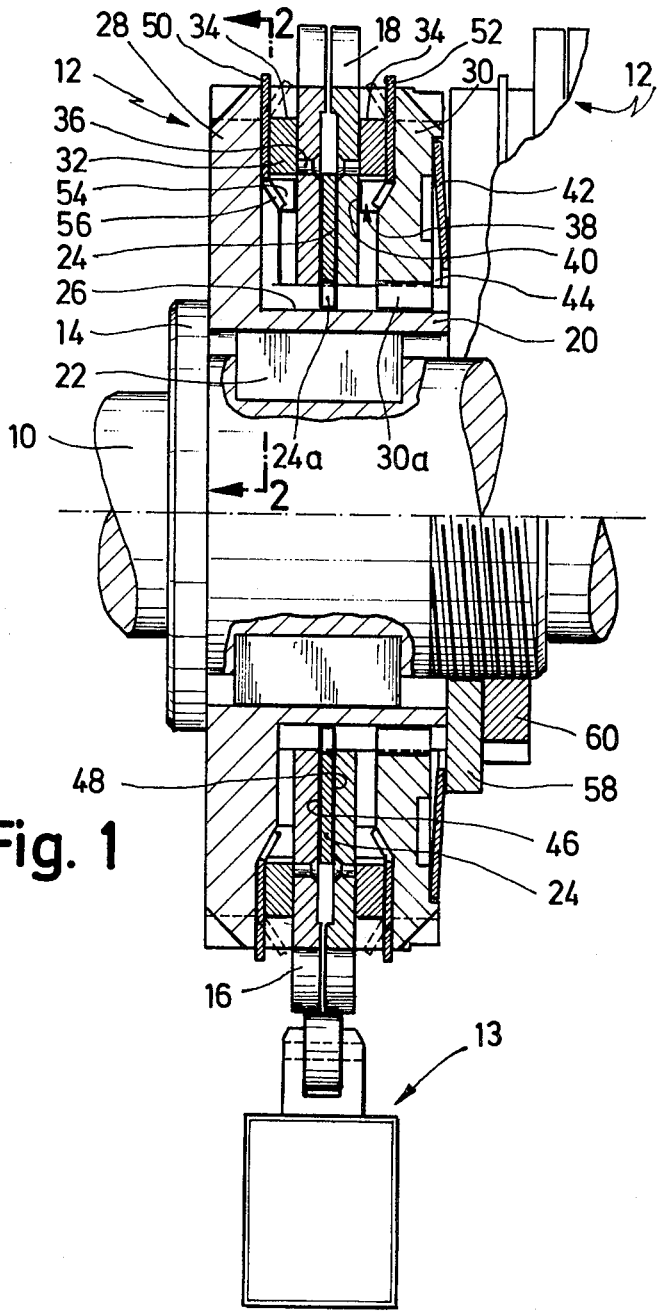
FIG. 1 a partial longitudinal section through a cam unit according to the invention disposed on the control shaft of a switching mechanism, two ways of wedging the cam discs together being illustrated.

A control shaft 10 is rotatably mounted in the casing of a switching mechanism. This casing is not illustrated. The control shaft is driven by the machine to be controlled or monitored and has several cam units 12 disposed on it one after the other in axial direction, each cam unit controlling an electric switch. FIG. 1 merely shows one of these cam units and a switch 13.

A switching mechanism of this type is completely illustrated and described for example in German Utility Model Specification 73 21 672. For this reason parts such as the casing of the switching mechanism or the switches to be activated by the cam units are not being illustrated and described.

The control shaft has a stop collar 14 in the area of one shaft end. This stop collar forms an abutment for the cam units 12 arranged on the control shaft. These cam units are locked on the control shaft, for example with the aid of a ring nut screwed onto the control shaft.

With the present embodiment the cam unit has, for example, two coaxially disposed cam discs 16, 18 having on their circumference contact cams diametrally opposite each other. These cam discs are rotatably mounted on a bearing bush 20 which is secured on the control shaft such that it cannot rotate, for example with the aid of a spring wedge, and abuts on the stop collar 14.

A centre plate 24 between the two cam discs is secured onto the bearing bush 20 such that it cannot rotate. This centre plate, like the two cam discs, is disposed and axially adjustable on the bearing bush 20.

In order to secure the centre plate 24 on the bearing bush 20 against relative rotation, the latter is provided with a longitudinal groove 26 worked into its circumference, into which the centre plate engages with a lug 24*a* molded onto its circumference, in order to provide essentially a form lock.

A supporting member is disposed adjacent to each of the outer end faces of the two cam discs 16, 18. The supporting member adjacent to the cam disc 16 is formed by an outer flange 28 molded onto the bearing bush 20 whereas the supporting member adjacent to the outside of cam disc 18 is formed by a thrust washer 30 secured on the bearing bush 20 such that it cannot rotate. In order for this thrust washer 30 to be secured against relative rotation, it engages with a lug 30*a* molded onto its inner circumference into the longitudinal groove 26 of the bearing bush 20 in order to provide essentially a form lock.

Each of the two cam discs has a tension ring 32 concentrically disposed and riveted on its outer end face. These tension rings have on their outer circumference continuous groove-like recesses 34 positioned at an angular distance from each other in axial direction. A tool, in particular a hook spanner, may be applied to the circumference of these tension rings in order to rotate the cam discs when these discs are correspondingly locked in relation to each other as described below in more detail. The tension ring 32 can also be designed as an integral part of the cam discs 16 or 18 or of impulse discs or discs having a pattern on their circumference.

FIG. 1 shows one of the rivet shanks, designated 36, connecting the tension rings with the cam discs. This figure also shows that the outer flange 28 and the thrust washer 30 each have a collar 38 on their end faces facing the cam discs. In the tightened state of the cam unit they abut with the end face 40 of this collar on the outer end face of the cam discs. The end faces of the centre plate also abut in friction contact on a cam disc. In the tightened state there is, however, a space between the two cam discs.

The clamping force for a frictional clamping of the cam discs 16, 18 on the control shaft is produced by an energy accumulator, preferably in the form of a spiral spring. The spiral spring is preferably a plate spring 42, which abuts with its portion having the greater conical diameter on the outside of the thrust washer 30. The portion of this plate spring having the smaller conical diameter is supported on an abutment which is formed for example by the adjacent cam unit 12.

The construction of the cam units is such that a selected contact pressure is produced with the aid of the plate spring 42 or an alternatively designed energy accumulator. This contact pressure may be calculated such that in the tightened state the cam discs are, even in the case of extreme acceleration or retardation in the action of the control shaft, on the one hand securely locked on the control shaft but on the other still rotatable with the aid of a tool applied to the tension rings to carry out any necessary correction in the position of the cam discs relative to each other.

This selected clamping force is brought about by the plate spring 42 being located in a space between the thrust washer 30 and the adjacent cam unit 12. The width of this space is constant and is defined by the axial length of the bearing bush 20 and the thickness of the thrust washer 30 whereby the abutment interacting with the plate spring 42 and formed by the cam unit 12 adjacent to it is supported on the free end face of the bearing bush 20.

The clamping force produced by the plate spring or the brake torque resulting from this for locking the cam disc on the control shaft is distributed by the arrangement described over two braking surfaces for each cam disc. One brake surface is the end face 40 of the collar 38 of outer flange 28 and thrust washer 30 while the other brake surface is formed by the end faces 46 and 48 of the centre plate 24.

The friction torque between the end faces of the cam discs abutting on each other and the centre plate is considerably increased when these parts have essentially the same metallurgical properties and are plane parallel to each other.

The surface of the end faces of the cam discs may of course be constructed in other suitable ways.

The construction described enables the diameter of the centre plate to be relatively large and the radial clearance of the collars 38 abutting on the outside of the cam discs 58 to be large, as seen from the inner circumference of the cam discs, so that a correspondingly large, effective brake torque is achieved.

Figure 2:
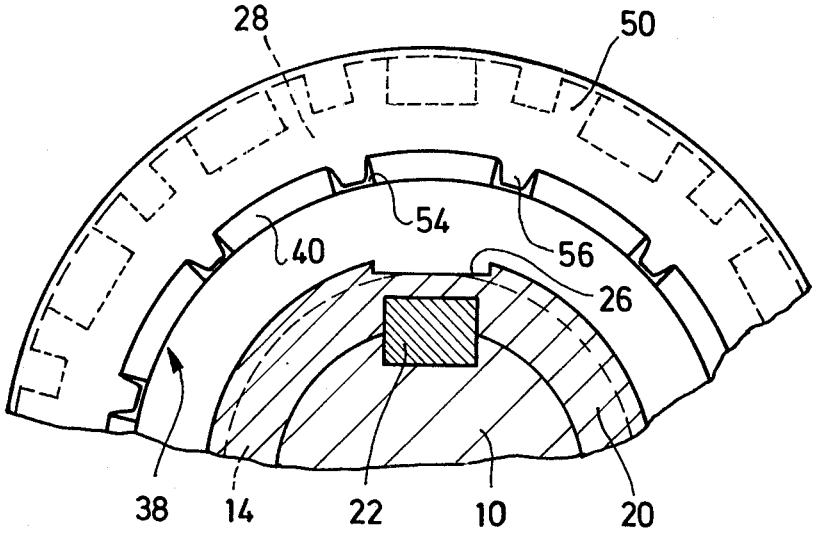
FIG. 2 a partial cross section through the cam unit along line 2—2 in FIG. 1.

The construction described also enables the cam discs to be connected with the control shaft in order to provide a form lock. For this purpose a locking washer 50 or 52 can for example be secured against relative rotation on each collar 38 of outer flange 28 and thrust washer 30, for which the collars are preferably provided with contact grooves 54 (FIG. 2) disposed at equal angular distances from each other. The locking washers engage in these grooves with the aid of gear teeth 56.

In order to produce a connection providing a form lock peripheral portions of the locking washers, which are malleable and consist preferably of sheet steel, can be bent into the notch-like recesses 34 in the tension rings 32 secured to the cam discs, as shown in FIG. 1 by broken lines.

A graduated scale is disposed on the outer circumference of the outer flange 28 and/or thrust washer 30, the degrees being preferably indicated at intervals of 30° with intermediate marks for every 10°.

The parts 24, 28, 30, 42 therefore form component parts of a securing means preventing relative rotation of the cam discs for producing a selected friction torque.

FIG. 1 also shows another variation of an abutment for tensing the plate spring 42. This abutment is formed by a tightening disc, which is placed on the control shaft and abuts on the free end face of the bearing bush 20, and a ring nut 60 screwed onto an outer thread on the control shaft, the tightening disc being secured by this ring nut on the control shaft relative to the thrust washer 30 to form the space 44 for the plate spring 42.

It is clear that the plate spring could also be disposed between the cam disc 16 and the outer flange 28 insofar as the cam disc 16 would be held at a predetermined distance from the outer flange 28 by a stop in order to be able to produce a selected clamping force with the aid of the plate spring.

I claim:

1. In a switching mechanism having a rotatable control shaft and several switches disposed along the control shaft which has an axis of rotation and carries a cam unit per switch for activation of said switch, at least one of said cam units having a set of at least two cam discs which are rotatable about said axis and securing means for preventing rotation of the cam discs relative to the control shaft, wherein the improvement comprises said securing means comprising a support member on each side of the set of cam discs of the cam unit, each of said support members being disposed on the control shaft and secured against rotation relative thereto and at least one of the support members being displaceable axially along the control shaft, at least one spring that acts in an axial direction with respect to said control shaft to produce a rotational frictional coupling between the cam discs and the support members of the cam unit, means for axially tightening said spring, axial stop means for defining an axial end position of said tightening means and therefore the maximum axial tension of the spring, and a friction disc carried by the control shaft and disposed between the cam discs of said cam unit, said friction disc being displaceable axially along the control shaft and secured against rotation relative thereto, said spring being located between said axial stop means and the cam disc facing said stop means.

2. Switching mechanism according to claim 1, further comprising narrow, right-shaped friction surfaces disposed in an axial direction with respect to said shaft between said cam discs and said support members and disposed in a radial direction at a distance approximately adjacent the radial middle sections of said cam discs.

3. Switching mechanism according to claim 1, wherein a first one of said support members has a flanged bush carried by the control shaft and secured against rotation relative thereto and the second said support member being located between the cam disc facing away from said first support member and said spring, the flange of the adjacent cam unit abutting against said bush and the spring so that an end face of the bush forms said axial stop means.

* * * * *